United States Patent [19]

Nastu

[11] Patent Number: 4,773,708

[45] Date of Patent: Sep. 27, 1988

[54] FOLDING CHAISE LOUNGE

[76] Inventor: Greg Nastu, 15 Adolph Pl., Bridgeport, Conn. 06604

[21] Appl. No.: 26,269

[22] Filed: Mar. 16, 1987

[51] Int. Cl.[4] ..... A47C 31/10

[52] U.S. Cl. ..... 297/423; 297/229; 297/17

[58] Field of Search ..... 297/423, 430, 188, 378, 297/457, 219, 229, 252, 16, 17, 18, 19; 5/417, 418, 419, 420

[56] References Cited

U.S. PATENT DOCUMENTS

| | | | |
|---|---|---|---|
| 2,279,748 | 4/1942 | Deak | 297/377 |
| 2,609,864 | 9/1952 | Gates, Jr. | 297/430 X |
| 2,649,139 | 8/1953 | Singleton | 297/430 X |
| 2,865,433 | 12/1958 | Warner | 297/252 |
| 2,919,746 | 1/1960 | Fidel | 297/423 X |
| 3,007,738 | 11/1961 | Gardel et al. | 297/430 |
| 3,215,469 | 11/1965 | Wamsley | 297/433 X |
| 3,544,157 | 12/1970 | Muller | 297/17 |
| 4,273,380 | 6/1981 | Silvestri | 257/229 |
| 4,518,198 | 5/1985 | Daniels | 297/229 |

*Primary Examiner*—Peter A. Aschenbrenner

*Attorney, Agent, or Firm*—Arthur T. Fattibene

[57] ABSTRACT

An improved folding chaise lounge or chair which includes a seat section having a hingedly connected back section and leg support sections which can be readily adjusted relative to each other in the unfolded position. The leg support section further includes a foot extender which is adjustably connected to extend or adjust the length of the leg support section to comfortably accommodate the comfort of persons of varying height. Included in the assembly are opposed pockets connected to the sides of the seat section which are constructed to receive, store and/or stow personal articles in either the folded or unfolded position of the chaise lounge or chair; and a handle is conveniently located to facilitate the carrying of the chaise lounge or chair in the folded position thereof. Folding leg members are hingedly connected to the opposite ends of the seat section whereby the leg members are folded inwardly to one side of the seat section as the back section and leg support section are folded inwardly to overlap each other on the opposite side of the seat section, with the pockets stowed between the folded back or leg support section and the seat section.

2 Claims, 3 Drawing Sheets

FOLDING CHAISE LOUNGE

FIELD OF INVENTION

This invention relates generally to folding lounge type chairs, and more specifically, to an improved folding lounge type chair that is readily portable with adjustable features to ensure added comfort and other conveniences.

BACKGROUND OF INVENTION

Over the years, efforts have been made to make the chaise or lounge chair more compact, portable, convenient and easier to carry. Due to these efforts, many compromises had to made in comfort and carrying conveniences. For instance, folding lounge chairs are not adjustable to fit in particular person's special physical characteristics, such as long legs. Folding chaise or lounge type chairs are also cumbersome and difficult to carry. The carrying of a folding chaise lounge is especially difficult when additional items must be carried. This is typically in situations when such folding or chaise lounge chairs are used the most, such as going to the beach, a concert, a picnic or other outdoor events; when other articles are generally carried or desired by the user.

The known prior art folding chaise lounge chairs such as disclosed in U.S. Pat. No. 2,279,748, entitled "Collapsible Chair" issued on Apr. 14, 1942, and U.S. Pat. No. 3,698,764, entitled "Chaise Lounge" issued on Oct. 17, 1972, provided some improvements in the convenience and the comfort of chaise lounge chair users, but they do not satisfy the ever increasing public demand for additional convenience and/or comfort. The Collapsible Easy Chair described in U.S. Pat. No. No. 2,279,748 has no provisions for carrying additional items. Various other conventional beach type chairs or lounges are known, e.g. the type covered with canvas or plastic webbing that can readily be folded. However, these prior known constructions were not adjustable to accommodate persons of varying heights, and/or constructed for carrying other personal articles desires by a person using such lounge. As with the known folding lounge construction, the overall length thereof was fixed; and constructed for persons of generally average height. Such lounge chair when used by a tall person proved uncomfortable because the tall person's feet generally extended beyond the length of the lounge chair, and would be totally unsupported.

OBJECTS

An object of this invention is to provide a folding chaise lounge chair which is constructed and arranged to increase the user's comfort.

Another object of this invention is to provide a folding lounge chair with additional comfort and conveniences with a minimum of manufacturing and/or use difficulties.

Another object of this invention is to provide an arrangement whereby additional personal items may be stored and stowed in either the unfolded or known-down or folded position of the chair or lounge.

Another object is to provide a folding chaise lounge with an adjustment whereby the length of the lounge can be optionally extended or shortened to comfortably suit a given user.

SUMMARY OF THE INVENTION

The foregoing objects and other features and advantages are attained by a folding type lounge or beach chair that includes a main seat section, an adjustably connected back section connected to one end of the seat section, and an extended leg supporting section hingedly connected to the other end of the seat section. The respective back and leg supporting sections are hingedly connected to the respective ends of the seat section so that they can be readily folded one on top of the other to define a compact nested arrangement in the knock-down position thereof, and which can be readily unfolded to its erected position. The remote end of the leg support section is provided with a foot extender which is telescopically connected to the leg support section, and which can be readily extended and retracted relative to the leg support section so as to extend the length of the leg support section if desired. The respective sections are formed of tubular members over which is stretched a suitable supporting sheet, webbing and/or the like to support the user's weight. In accordance with the invention, the supporting sheet stretched over the frame of the seat section is provided or has connected thereto pockets which are dependently supported by the side frame members of the seat section for storing or carrying personal articles the user may desired; e.g. book, magazine, radio, sun lotion, clothing, towels, etc. The construction is such that the pockets together with the articles therein can be readily stowed in the knock-down position of the chaise or lounge chair.

Leg members are connected to the seat section at the junction of the leg support section and back section, and which leg members can be readily folded in the knock-down position whereby the leg members are folded in a direction opposite to the folded position of the leg section and back section to form a compact readily portable unit. A handle is conveniently located to facilitate portage of the folded lounge or chair.

FEATURES

A feature of this invention resides in the provision of a folding chaise lounge or chair which is readily simple in construction and positive in operation.

Another features resides in a foldable chaise lounge in which the leg support section has a foot extender which can be readily adjusted or extended to comfortably accommodate persons of different heights.

Another features resides in providing a chaise lounge of the folding type with pockets in which various articles can be stored or stowed in either the erected or knock-down position.

Another feature resides in foldable chaise lounge or chair having a slideable adjustable foot extension and folding pockets attached to each side of the seat section.

Another features resides in the provision of a handle which is suitably connected to the seat portion which is rendered accessible when the chaise lounge is in its folded or knock-down position, and which is disposed in an out of the way and out of sight position in the unfolded position.

DETAIL DESCRIPTION

Figure 1:
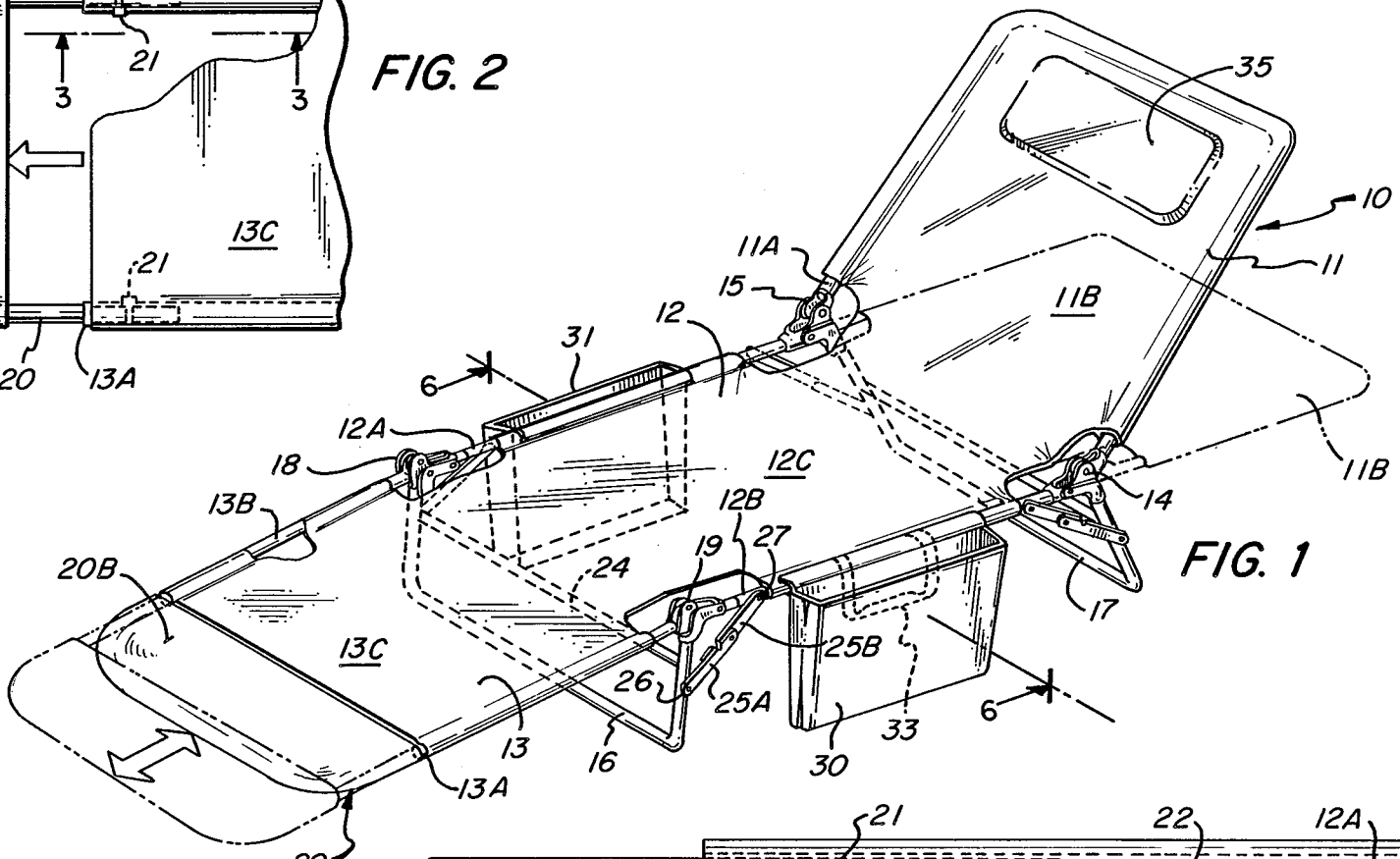
FIG. 1 is a perspective view of the chaise lounge or chair of this invention illustrated in an erected or unfolded position.

The improved folding lounge or chair 10, as shown in FIG. 1, comprises a back section 11, a seat section 12 and a supporting leg section 13. The back section includes a U-shaped frame member 11A over which there is stretched a cover 11B which may be formed of any suitable material such as canvas, cotton, plastic, webbing and the like. The back frame 11A is preferably formed of a light weight tubular material, e.g. tubular aluminum. The free ends of the back frame 11A are hingedly connected to the end portion of the seat section 12 by suitable hinge means 14 and 15. The hinges 14 and 15 are constructed so that the back section 11 can be readily adjusted between a vertical position or a fully reclining position as shown in the dotted line position, or in any adjusted position therebetween. The hinge construction is such that is will also maintain the back section 11 in its adjusted position.

The seat section 12 comprises a pair of side frame members 12A and 12B that are maintained in spaced relationship by the folding leg members 16 and 17 as will be hereinafter described. The side frame members 12A and 12B are likewise formed of light weight tubular material. Stretched across the side frame members is a covering material like that stretched over the back frame 11A. As shown in FIG. 1, a portion of the covering material adjacent to the hinges 14 and 15 is cut away to provide clearance for the hinge mechanism 14 and 15.

Connected to the other end of the seat frame members 12A and 12B is an adjustable leg support section 13. The leg support section 13 includes a pair of leg support frame members 13A and 13B, which are also of a tubular construction of light weight material. The leg support section or frame members 13A and 13B are pivotably connected to the seat section 12 by means of hinges 18 and 19. The hinges 18 and 19 like hinges 14 and 15 allow the leg support section to be adjusted in various angled positions and maintained in the adjusted position suitable to the user. Stretched across the side leg frame members 13A and 13B is a cover 13C of material or webbing which may comprise a construction like the cover 12C and 11B.

Figure 2:
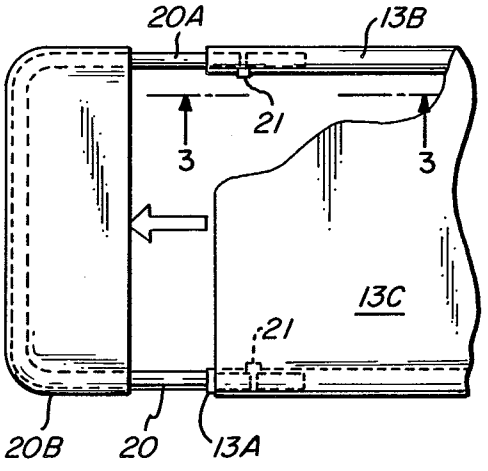
FIG. 2 is a partial plan view of the leg and connected foot section.

Telescopically connected to the ends of the leg side frame members 13A and 13B is a foot section 20. The foot section 20 comprises a U-shaped frame 20A of suitable tubular or rod like materials, the ends of which are telescopically fitted to the ends of the leg side frame members 13A, 13B. Stretched across the bite position of the foot section 20 is a covering material 20B. As best seen in FIGS. 1 and 2, the foot section 20 can be readily extended or retracted relative to the leg support section 13 so as to extend or shorten the length thereof as desired.

Figure 3:
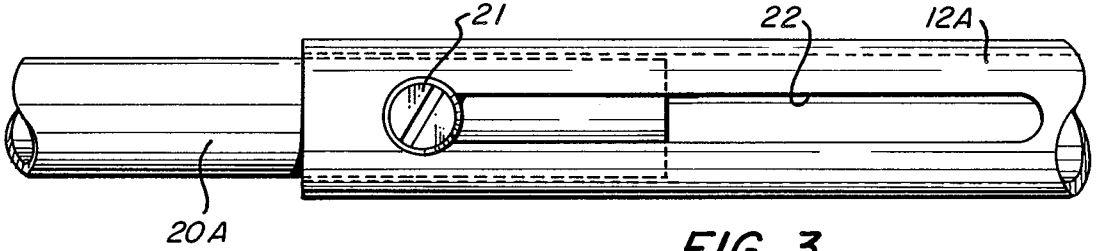
FIG. 3 is an enlarged detail, side elevation view of a portion of the invention looking along line 3—3 in FIG. 2.

To prevent unintentional separation between the foot section 20 and the leg support section 13, a stop means is provided. The stop means comprises a stop pin 21 which extends laterally of the foot frame 20 and which rides in an elongated slot 22 formed adjacent the end position of the leg support frame members 13A and 13B. As best seen in FIG. 3, the foot section can be readily adjusted relative to the leg support section between a protracted and retracted position. Also, the foot section 20 is angularly adjusted in unison with the angular adjustment of the leg support section 13. The stop pin may comprise a lock type stud or screw which may be used to secure the foot extension 20 in the adjusted position thereof.

Figure 4:
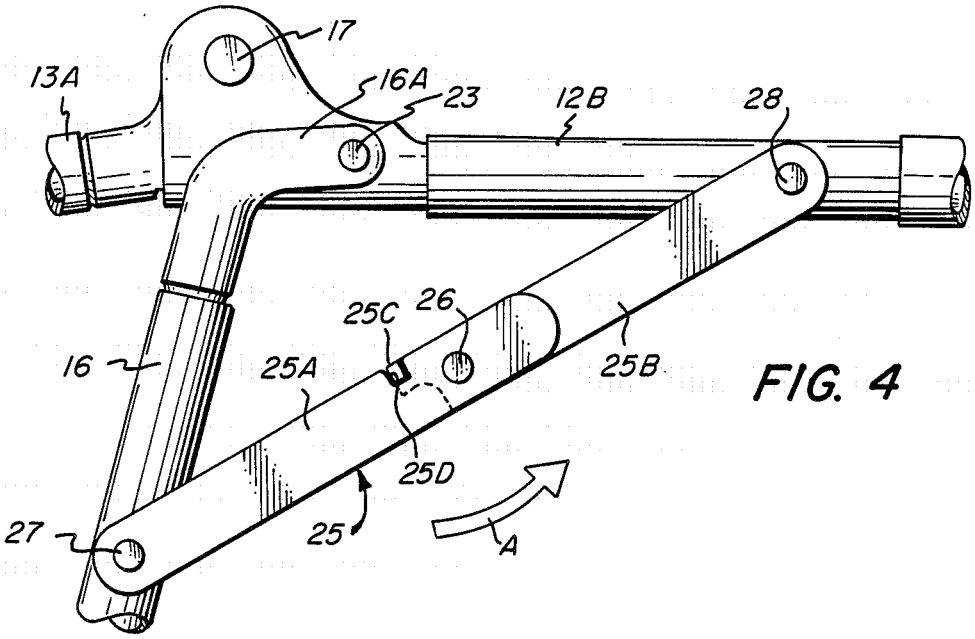
FIG. 4 is a partial side elevation view of the invention shwoing the hinge connection between the seat section and the leg and foot section.

FIG. 4 illustrates the details of construction of the hinge means by which leg member 16 is folded relative to the seat section 12. As shown the free end 16A of the U-shaped leg member 16 is pivotally connected to the hinge structure by a pivot pin 23. The other end of leg member is similarly connected to the other side. A cross piece 24 may be extended between the free ends of the U-shaped leg member 16 for added rigidity.

Figure 5:
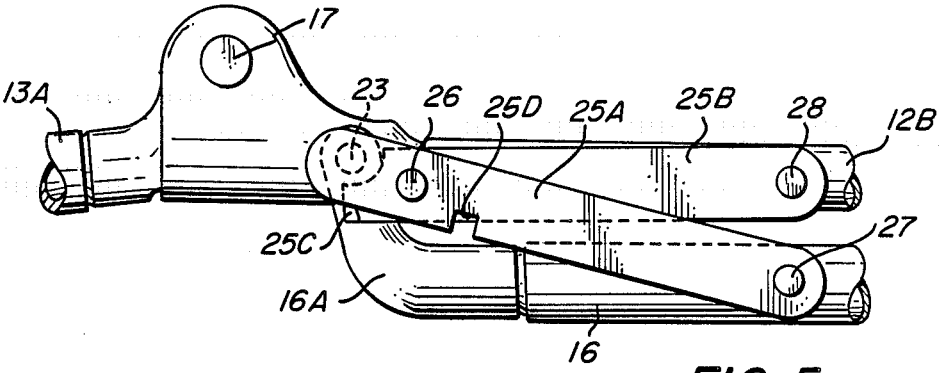
FIG. 5 is a side elevation of a portion of the invention of FIG. 4 showing the supporting leg in the folded position.

A toggle linkage means 25 is interconnected between the sides of the leg member 16 and its corresponding side frame member 12B, as best seen in FIGS. 4 and 5.

The toggle linkage comprises a pair of links 25A and 25B. The adjacent ends of links 25A and 25B are pivotally connected about a common link pin 26. The other end of link 25A is pivoted to leg member 16 about pivot 27, and the other end of link 25B is connected to the leg side frame 12B about pivot 28.

To prevent the toggle linkages 25A and 25B from collapsing in the unfolded position, as shown in FIG. 4, a stop lug 25C is laterally blanked from link 25B, and which lug 25C is adapted to engage a notch 25D formed in link 25A. The arrangement is such that the lug 25C engages notch 25D in the erected position of the leg member 16 to secure the same in the extended position as shown in FIG. 4. To collapse or fold the leg member 16 to its knock-down position, the leg member 16 is folded in the direction of arrow A, as shown in FIG. 4 to fold the leg member toward the bottom of the seat portion 12. The other leg member 17 is similarly constructed. Accordingly, the respective leg members 16 and 17 are arranged to fold inwardly toward each other in the knock-down position, as evident from the showing of FIG. 1.

This invention further contemplates a means for stowing personal articles which a user may desire, when such chair is being used. Accordingly, side or saddle type pockets 30 and 31 are provided.

Figure 6:
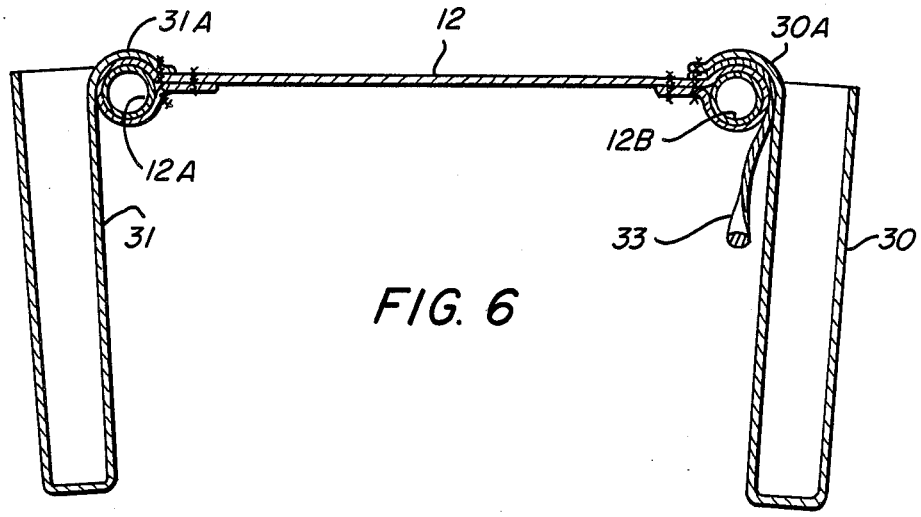
FIG. 6 is a sectional view taken along line 6—6 in FIG. 1.

FIG. 6 illustrates the construction of the folding pockets 30 and 31. Body frame cover portion 12C is wrapped around each side of tubular body frame 12A and 12B respectively. Each pocket 30 and 31 has a flap 30A, 31B, that is positioned over a part of the body frame cover extending over the seat frame 12A, 12B, by which the respective pockets are secured to the covering material, e.g. by means of stitching, adhesive, rivets or the like. It will be understood that the pockets 30, 31 may be formed of a fabric or plastic material.

Figure 7:
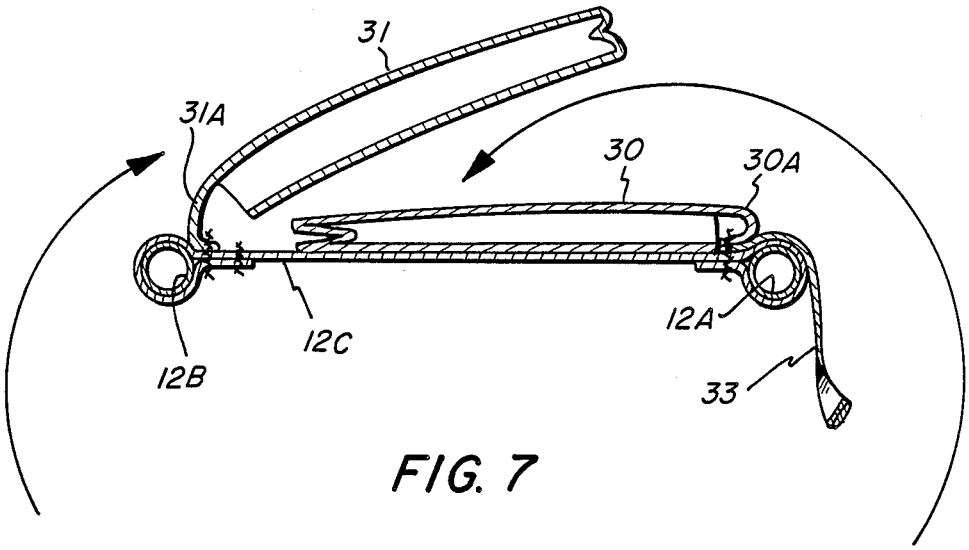
FIG. 7 is a sectional view taken across the seat section to illustrate the stowing of the side pockets in preparation to folding of the lounge to its folded knock-down position.

FIG. 7 illustrates how the folding pockets 30, 31 are folded on top of the seat section 12 when the lounge chair is to be folded. The arrangement is such that any articles in the pockets can be left therein when folding the pockets 30,31 to the knock-down position, whereby the articles are prevented from falling out by the manner in which flaps 30A and 31A closes the open end of the pockets in the knock-down position.

Figure 8:
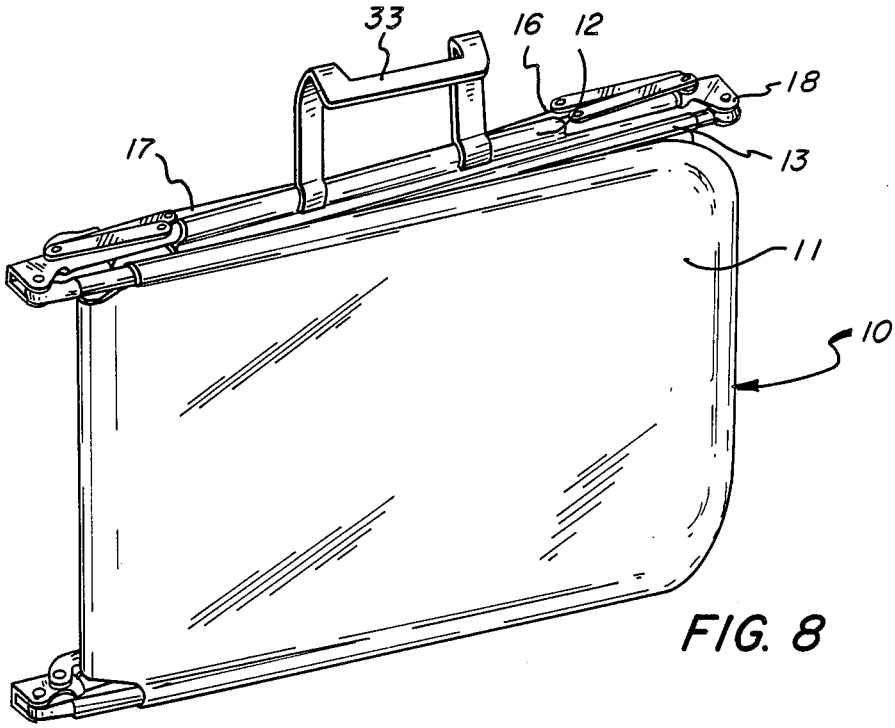
FIG. 8 is a perspective view of the invention in its folded and carrying position.

In FIG. 8, the folded lounge chair is shown ready for convenient carrying. As can be seen, the leg members 16 and 17 are folded over against the bottom side of the seat portion 12 and back secton 11 and leg support section 13 are folded against the top portion of the seat section 12, i.e. to the other side of the seat portion 12.

To facilitate carrying the lounge or chair in the knock-down position, a handle means is provided. As shown in FIGS. 1, 6 and 7, the handle means comprises a strap or loop 33 which has its ends connected to the seat portion 12.

As shown in FIG. 1, the handle or loop 33 is obscured by the pocket 30. In the folded position, as shown in FIGS. 7 and 8, the handle or loop 33 is rendered accessible for carrying the lounge or chair in the knock-down position. In the unfolded position, the handle 33 is obscured by the pocket 30, and is disposed in an out of the way position.

If desired, a head cushion or pad 35 may be incorporated in the back section 11.

From the foregoing description, it will be evident that the chaise lounge or chair is formed of light weight materials that can be readily folded from its erected position to a compact knock-down or folded position and which includes adjustable features arranged to accommodate the size and/or comfort of a given user, and which also includes side pockets in which personal articles can be carried and/or stowed in either the folded or unfolded position.

It should be understood, of course, that the foregoing description relates to a preferred or illustrated embodiment of the invention, and that numerous modifications, variations and/or alterations may be made without departing from the spirit or scope of the invention as set forth in the appended claims.

What is claimed is:

1. A chaise lounge adapted to be readily folded between an operative and inoperative position comprising a seat section, a back section hingedly connected to one end of said seat section, a leg support section hingedly connected to the other end of said seat section, a foot extender, said foot extender including a U-shaped frame structure telescopically connected to said leg support section whereby said foot extender is rendered adjustable relative to said leg support section to extend the length thereof, means for securing said foot extender in the adjustable position thereof, said leg support section and connected foot extender being angularly adjustable in unison relative to said seat section, and said back section being adjustable relative to said seat section, leg members hingedly connected to the respective ends of said seat section, toggle linkages interconnecting said leg member to said seat section, and a pocket means connected to the side of said seat section, said pocket means including an open end pocket;

and flap means for suspendingly supporting said pocket to a side portion of said seat section, said latter flap means including a flap having opposed edges, means for securing one edge of said flap to said seat section whereby said pocket can be readily suspended from said seat section in the operative position and folded relative to said seat section in overlying relationship to said seat section in the folded position of said chaise lounge, said pocket being adapted to support personal articles in either the operative or inoperative position of said chaise lounge, and whereby said flap defines a closure for said open end pocket in the folded position of said chaise lounge wherein said seat section and said leg section and connected foot extender are folded to overlie one side of said seat section, and said leg members are folded inwardly toward each other to overlie the other side of said seat section.

2. A folding chaise lounge which is readily foldable between an erected operative position and a folded inoperative position comprising a seat section defined by opposed spaced apart side tubular frame members, a back section including a U-shape tubular frame member, hinge means for hingedly connecting the ends of said back U-shaped tubular frame member to the adjacent ends of said corresponding seat section frame member, a leg support section including opposed tubular leg side support members, said tubular leg side support members being hingedly connected to the adjacent end of said corresponding seat frame members, a foot extender, said foot extender comprising a U-shape frame member having free ends, the free ends of said U-shaped foot extender member being telescopically slidably connected to the free ends of said leg support frame members, means for adjustably securing said foot extender in an adjusted position relative to said leg support frame members, a covering material stretched over the frame members of said back section, seat section and said leg support section, pocket means connected to the sides of said seat section, said pocket means including an open ended pocket having an edge portion, a flap connected to an edge portion of said pocket for connecting said pockets to its corresponding side portion of said seat section, said flap in the unfolded position of said chaise lounge suspendedly supports said pocket from seat section, and whereby said flap allows said pocket to be folded onto the seat portion in the folded position of said chaise lounge so that said flap overlies the open ended pocket to form a closure for said pocket, a handle means connected to a side portion of said seat section, and leg members, each of said leg members comprising a U-shape member having opposed free ends, the opposed free ends of each U-shaped leg members being hingedly connected to the corresponding ends of said seat frame members, a toggle linkage interconnected between each of the free ends of said leg members and the corresponding seat frame member, said toggle linkage including a pair of complimentary links, a hinge pin pivotably connecting the adjacent ends of said complimentary links, and means for limiting the rotation of said links in the unfolded position thereof, said limiting means comprises a complimentary lug and notch formed in said complimentary links.

* * * * *